US008024879B2

(12) United States Patent
Pulfer

(10) Patent No.: US 8,024,879 B2
(45) Date of Patent: Sep. 27, 2011

(54) THREE-DIMENSIONAL BACK-LIT DEVICE

(75) Inventor: Bernard Pulfer, Bex (CH)

(73) Assignee: Homdec SA, Yvorne (CH)

( * ) Notice: Subject to any disclaimer, the term of this patent is extended or adjusted under 35 U.S.C. 154(b) by 61 days.

(21) Appl. No.: 12/537,904

(22) Filed: Aug. 7, 2009

(65) Prior Publication Data

US 2010/0064560 A1 Mar. 18, 2010

Related U.S. Application Data

(63) Continuation-in-part of application No. PCT/IB2008/000389, filed on Feb. 1, 2008.

(30) Foreign Application Priority Data

Feb. 8, 2007 (FR) ..... 07 00881

(51) Int. Cl.
*G09F 7/22* (2006.01)

(52) U.S. Cl. ..... 40/561; 283/81; 215/6

(58) Field of Classification Search ..... 40/561, 40/409, 311, 324, 410, 310, 617; 215/6, 215/10, 379

See application file for complete search history.

(56) References Cited

U.S. PATENT DOCUMENTS

| | | | | | |
|---|---|---|---|---|---|
| 2,810,978 | A | * | 10/1957 | Chapman | 40/310 |
| 3,738,041 | A | * | 6/1973 | Rattner | 40/561 |
| 4,094,501 | A | * | 6/1978 | Burnett | 472/63 |
| 5,139,455 | A | * | 8/1992 | Israel | 446/219 |
| 5,229,884 | A | * | 7/1993 | Kelderhouse et al. | 359/616 |
| 5,758,440 | A | * | 6/1998 | Yudin | 40/310 |
| 5,904,268 | A | * | 5/1999 | Daly | 220/703 |
| 6,135,654 | A | * | 10/2000 | Jennel | 400/61 |
| 6,283,605 | B1 | * | 9/2001 | Kalamaras | 362/101 |
| D479,132 | S | * | 9/2003 | Boutilier | D9/550 |
| 6,622,878 | B1 | * | 9/2003 | Frey | 215/12.2 |
| 7,010,877 | B2 | * | 3/2006 | Geary | 40/310 |
| 7,290,361 | B2 | * | 11/2007 | Liao | 40/409 |

FOREIGN PATENT DOCUMENTS

| | | | |
|---|---|---|---|
| FR | 2 843 224 | A1 | 6/2004 |
| GB | 2 258 937 | A | 2/1993 |
| JP | 2002-268598 | A | 9/2002 |
| WO | 2004/015658 | A1 | 2/2004 |

* cited by examiner

*Primary Examiner* — Joanne Silbermann
*Assistant Examiner* — Shin Kim
(74) *Attorney, Agent, or Firm* — Robert Iannucci; Seed IP Law Group PLLC

(57) ABSTRACT

A display device includes at least one wall with transparent areas and a reflecting object arranged inside the display device and oriented so as to receive an incident external light and to redirect a reflected light onto the transparent areas. The transparent areas are provided in different planes and the reflecting object includes several reflecting surfaces or a non-planar reflecting surface to reflect incident light rays on each of the transparent areas along different reflection axes. The display device can advantageously be integrated into a bottle or a bottle cap.

19 Claims, 3 Drawing Sheets

THREE-DIMENSIONAL BACK-LIT DEVICE

BACKGROUND

1. Technical Field

The present disclosure relates to a device comprising at least one wall with transparent areas, and a reflecting object arranged inside the device and providing the back-lighting of the transparent areas.

2. Description of the Related Art

A device of the above-mentioned type is described in the international application WO 2004/015658 as a back-lit display. The transparent areas forming back-lit decorative patterns or advertising signs are provided on a planar wall of the device.

BRIEF SUMMARY

One embodiment is a device offering more applications and that is less costly to implement than the prior art device.

One embodiment is a decorative device comprising at least one wall with transparent areas and a reflecting object arranged inside the decorative device and oriented so as to receive an incident external light and to redirect a reflected light onto the transparent areas, to provide a back-lighting of the transparent areas, in which the transparent areas are provided in different planes, and the reflecting object comprises several reflecting surfaces or a non-planar reflecting surface to reflect incident light rays along different reflection axes, in order to back-light each of the transparent areas.

According to an embodiment, the reflecting object comprises reflecting surfaces arranged according to a pyramidal arrangement.

According to an embodiment, the reflecting object comprises a reflecting surface in the form of a cone or a truncated cone.

According to an embodiment, the reflecting object comprises two reflecting surfaces arranged back-to-back according to a triangular arrangement.

According to an embodiment, the reflecting object has a base positioned flat in the device.

According to an embodiment, the device forms a bottle, the transparent areas being arranged on one wall of the bottle, the bottle comprising a watertight housing receiving the reflecting object.

According to an embodiment, the device forms a cap of a bottle, the transparent areas being arranged on one wall of the cap, the cap comprising a watertight housing receiving the reflecting object.

According to an embodiment, the reflecting object is arranged to redirect back onto the transparent areas an incident light emitted substantially vertically to the device.

According to an embodiment, the device comprises at least one colored filter arranged along the path of the light, upstream or downstream of the reflecting object.

According to an embodiment, the transparent areas form all or part of a decorative element, of a logo, of a trademark, or any other distinctive sign.

One embodiment is a decorative device comprising at least one wall with at least one transparent area and a reflecting object provided inside the decorative device and oriented so as to receive an incident external light and to redirect a reflected light onto the transparent area. The device forms a bottle or a cap of a bottle, and the transparent area is arranged on one wall of the bottle or cap while the reflecting object is arranged in the bottle or the cap.

According to an embodiment, the device comprises several transparent areas arranged in different planes, and the reflecting object comprises several reflecting surfaces or a non-planar reflecting surface, to reflect incident light rays along different reflection axes, in order to back-light each of the transparent areas.

According to an embodiment, the reflecting object is arranged in a watertight housing provided in the bottle or in the cap.

BRIEF DESCRIPTION OF THE SEVERAL VIEWS OF THE DRAWINGS

Embodiments of the present disclosure will be described in the following description, in relation with but not limited to the following figures, in which.

DETAILED DESCRIPTION

In the following, two embodiments of the present disclosure will be described. A device according to the first embodiment comprises a reflecting object having several reflecting surfaces or one non-planar reflecting surface having different reflection axes, allowing elements in different planes to be back-lit. A three-dimensional back-lit device is thus realized, and not a device having coplanar back-lit areas, as described by WO 2004/015658.

In a simple yet no-less inventive manner, the second embodiment allows for the application to a bottle or a bottle cap of a device of the type described by WO 2004/015658. Thus, a bottle or a cap according to the invention has a back-lit wall. This embodiment can be implemented in combination with or independently of the first embodiment.

Figure 1A:
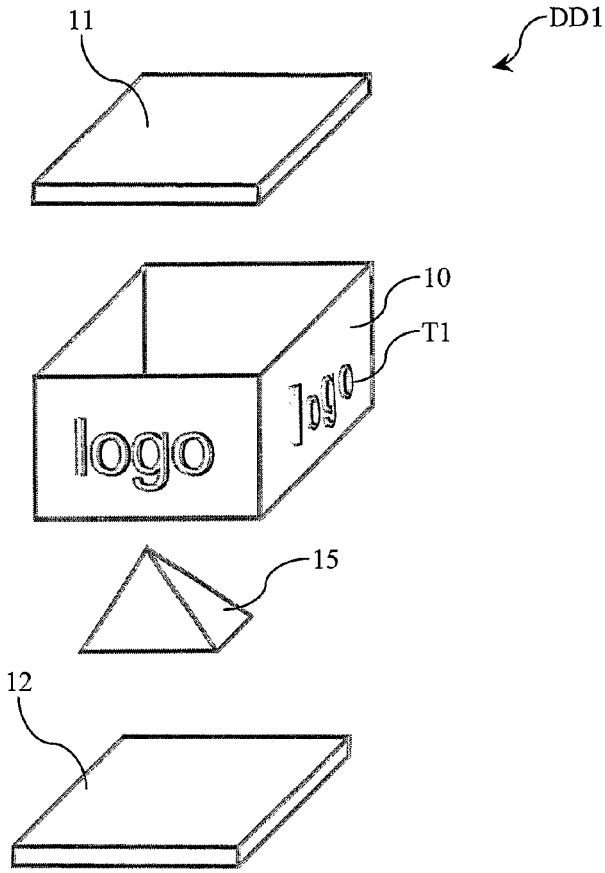
FIGS. 1A, 1B show respectively by an expanded view and a perspective view a first example embodiment of a display device.
Figure 1B:
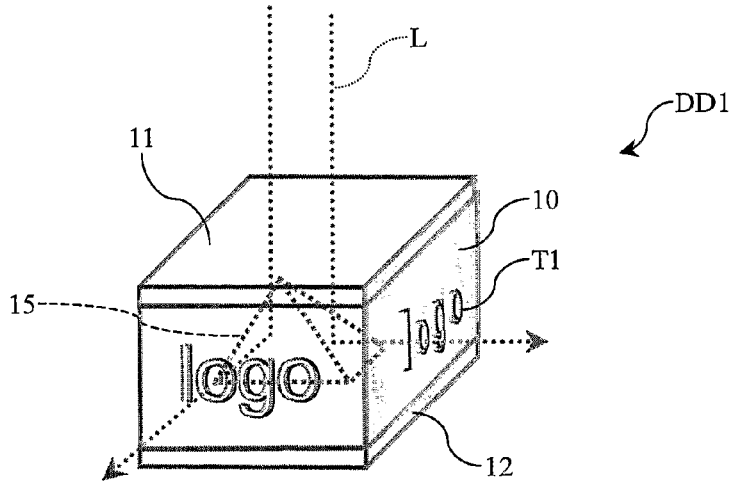

A first example embodiment of a device DD1 according to the present disclosure is shown by an expanded view in FIG. 1A and a perspective view in FIG. 1B, certain elements being shown by transparency. The device DD1 comprises a box of a parallelepiped form having four lateral walls 10, a transparent lid 11 and a bottom 12. Each wall 10 has an opaque aspect and certain walls, preferably all four, comprise transparent areas T1 forming all or part of a decorative element, of a logo, of a trademark, or of any other distinctive sign. Here, on each wall one can distinguish an area forming an "l", an area forming an "o", an area forming a "g" and an area forming an "o", the ensemble forming the word "logo".

The box receives a reflecting object 15 of a pyramidal form with four lateral surfaces. Each lateral surface carries out the back-lighting of one of the walls 10, by receiving the incident light rays L that arrive vertically and traverse the lid 11.

The box can be made according to various techniques and of various materials. It can be for example in cardboard, wood, metal, etc. In this case, the transparent areas forming the word "logo" can be orifices made in the lateral walls. These orifices can be covered with a transparent film, colored or not. The box can also be made with acrylic glass or with "PMMA" (Polymethyl methacrylate) with a dark tint within the mass or on the surface (screen printing) to obtain the opaque areas that define the transparent areas, which may be tinted. It can also be in polystyrene, polyethylene, or polypropylene. The reflecting object 15 can be made by means of a material such as cardboard, wood, plastic, or metal and covered with a reflecting material such as a sheet of aluminum. The objet 15 can equally comprise a metallic or plastic framework structure for maintaining the reflecting material. It can equally be formed by the assemblage of four pieces of a mineral mirror, this embodiment being of a low cost but having the inconvenience of being fragile. The reflecting object 15 has a base that is placed flat on the bottom of the box, and is preferably fixed to it, for example by gluing.

The lid 11 can receive a colored filter, for example a filter comprising a gradation of colors creating esthetic watering effects in the back-lighting of the transparent areas.

In an embodiment variation not shown in the figures, the pattern to back-light, for example the word "logo" is arranged on the lid 11, which therefore comprises opaque areas defining the pattern. In this case, each of the faces of the reflecting object 15 redirects the back-lit pattern towards the walls 10 of the box. The transparent areas provided on the walls 10 are types of "windows" allowing to see the image reflected by the object 15, which therefore seems to float in space. In such an embodiment, the walls 10 of the box can also be entirely transparent, because they do not themselves comprise the decorative pattern.

Figure 2:
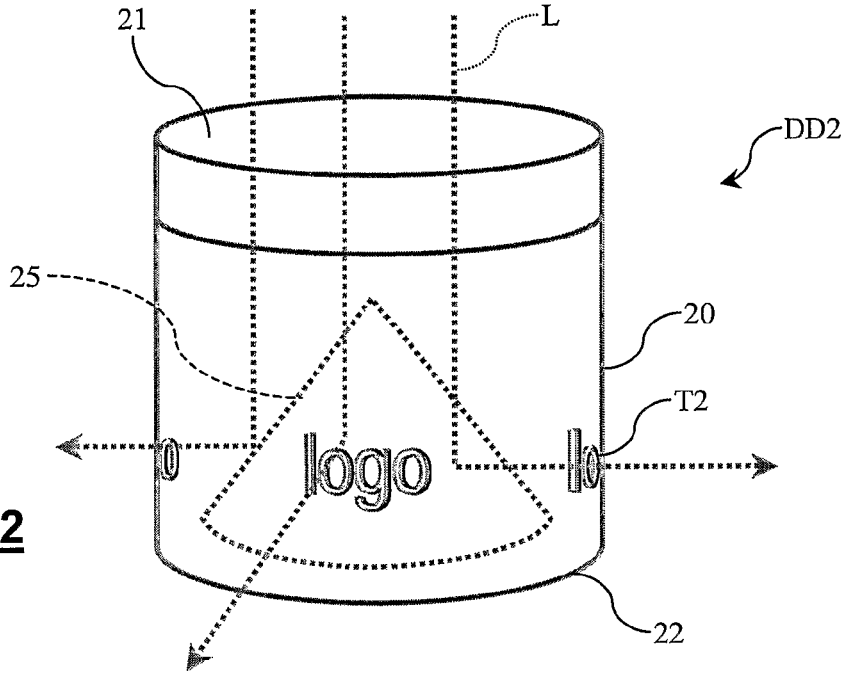
FIG. 2 shows a perspective view of a second example embodiment of a display device.

The decorative device DD2 shown in FIG. 2 comprises a box having a cylindrical wall 20, a transparent lid 21, and a bottom 22. Transparent areas T2 again forming the word "logo" are arranged along an annular region around the perimeter of the cylindrical wall 20. As previously, a reflecting object 25 is placed inside the box. The reflecting object 25 is here of a cone or truncated cone form and redirects towards the cylindrical wall 20 the light rays penetrating into the box by the intermediary of the lid 21. The box and the reflecting object can be made by means of the techniques and materials indicated above.

Figure 3:
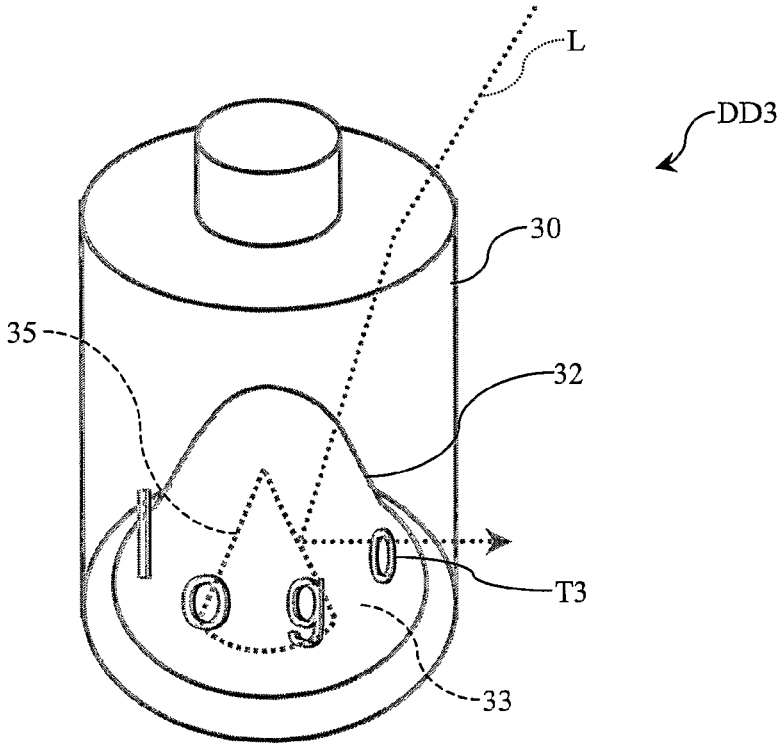
FIG. 3 shows a perspective view of a third example embodiment of a bottle.

FIG. 3 relates to the second embodiment and shows a bottle DD3. The bottle DD3 contains or is made to contain a liquid, for example a perfume. The bottle DD3 here has a body of a cylindrical form delimited by a cylindrical wall 30. The bottom of the bottle 32 has a rounded form oriented upwards (towards the inside of the bottle) and defines a watertight housing 33. On the inside of the housing 33 is arranged a cone or truncated cone reflecting object 35 made according to one of the above-described techniques, for example a cardboard cone covered by a sheet of reflecting material. A counter-plate (not shown in the figure) is arranged on the bottom of the housing 33 to maintain the reflecting object in the housing. The wall 30 of the bottle has transparent areas T3 defined by opaque areas. In this example, the transparent areas are arranged along an annular region around the perimeter of the bottle and again form the word "logo". Thus, the light rays L penetrate the bottle by its upper part, traverse the bottom 32 of the bottle and penetrate into the watertight housing 33, reflect off of the cone or truncated cone object 35, then traverse, in the opposite direction, the bottom 32 and provide the back-lighting of the transparent parts.

Figure 4A:
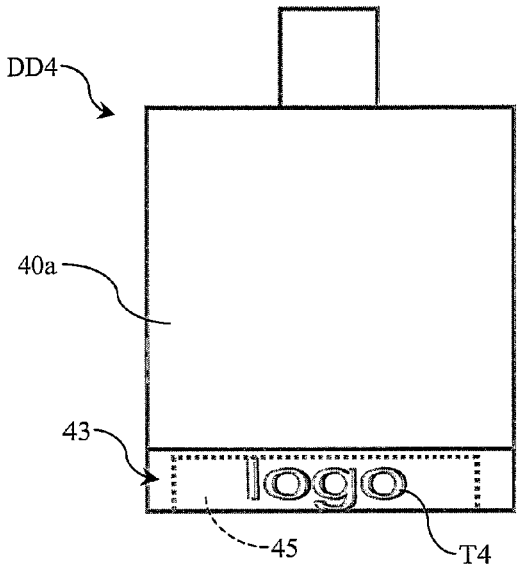
FIGS. 4A, 4B show respectively by a front view and a side view a fourth example embodiment of a bottle.
Figure 4B:
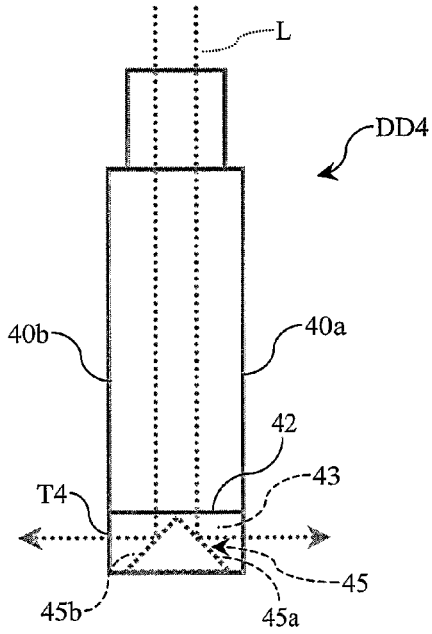

FIGS. 4A and 4B show another bottle, respectively by a front view and a side view. The bottle DD4 is here of a parallelepiped form and has four lateral walls of which two parallel walls 40*a*, 40*b* comprise transparent areas T4 delimited by opaque areas, here forming the word "logo". The bottle DD4 comprises a bottom 42 that is arranged above the lowest part of the four lateral walls and which thereby delimits, with the lower part of the lateral walls, a watertight housing 43. The housing 43 receives a reflecting object 45, here comprising two reflecting surfaces 45*a*, 45*b* arranged back-to-back according to a triangular arrangement (side view, FIG. 4B). The transparent areas T4 are arranged on the lower part of the walls 40*a*, 40*b*, which are across from the reflecting surfaces 45*a*, 45*b*. Thus, the light rays L penetrate into the bottle by its upper part, traverse the bottom 42 of the bottle and penetrate into the housing 43, then are reflected off the object 45 to illuminate the transparent areas without again traversing the bottom 42 of the bottle.

In an alternative embodiment, the object 45 only comprises one reflecting surface 45*a* or 45*b* and the decorative pattern is only on one surface 40*a* or 40*b*.

Figure 5A:
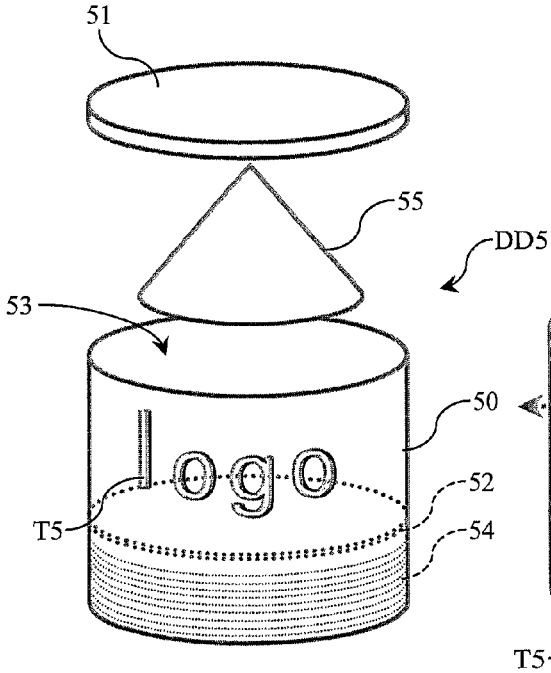
FIGS. 5A, 5B show respectively by an expanded view and a perspective view a fifth example embodiment of a bottle.
Figure 5B:
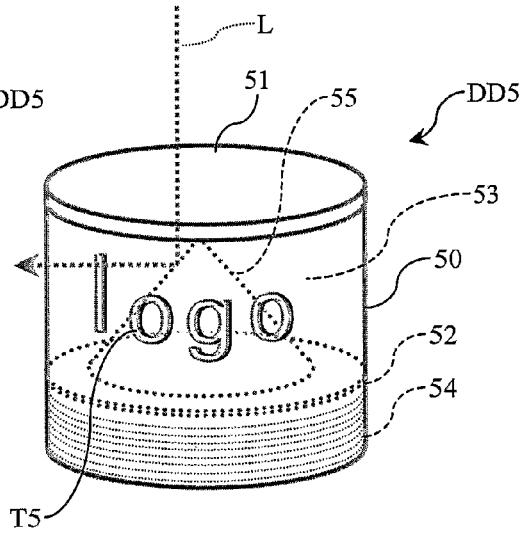

FIGS. 5A, 5B equally relate to the second embodiment and show a decorative device in the form of a cap DD5 of a bottle, the cap being shown respectively by an expanded view and a perspective view. The cap DD5 comprises a cylindrical wall 50. On the inside of the cap, a horizontal partition 52 separates a lower part and an upper part of the cap. The lower part comprises a tapping 54 forming a female screw thread allowing the cap to be screwed on a bottle. The upper part forms a watertight housing 53 in which is arranged a reflecting object 55, with a cone or truncated cone form. The housing 53 is sealed by means of a transparent disk 51. Transparent areas T5, here forming the word "logo", are made in the upper part of the cylindrical wall 50, with respect to the reflecting cone object 55. Thus, the light rays penetrate into the cap by the intermediary of the disk 51 and are reflected back directly onto the transparent areas.

The reflecting object 55 can be made by means of the diverse techniques and materials previously described. As previously, the transparent areas can equally be arranged on the disk 51, which therefore comprises opaque areas defining the transparent areas. In this case, the cylindrical wall 50 can be entirely made of a transparent material, so that the image of the decorative pattern reflected by the object 55 is visible no matter what the orientation of the cap.

It will clearly appear to the skilled person that a device according to the present disclosure is susceptible of diverse alternative embodiments, as far as its form and its structure, as well as the form, the arrangement, and the structure of the reflecting object inside of the device, as well as diverse applications (pens, watches, jewelry, hair accessories, etc.).

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A bottle, comprising:

a body having an interior space;

a cap configured to be attached to the body and close the interior space;

a watertight housing positioned inside the body or the cap;

a light input surface located in an upper part of the bottle and including a first transparent area through which incident external light penetrates the bottle;

a reflective object arranged inside the watertight housing, receiving the incident external light and emitting reflected light;

a light output surface with at least a second transparent area through which at least some of the reflected light leaves the watertight housing; and at least one opaque area surrounding the first transparent area or the second transparent area, the at least one opaque area forming with the first or second transparent area a decorative pattern, wherein the reflective object receives the incident external light and redirects reflected light through the second transparent area, to provide a back-lighting of the decorative pattern or project an image of the decorative pattern through the second transparent area.

2. The bottle according to claim 1, in which:

the light output surface is one of plural light output surfaces with respective transparent areas arranged in different planes, and the reflective object is configured to reflect incident light rays along different reflection axes passing through the light output surfaces.

3. The display device according to claim 1, in which the reflective object comprises one of the following structures: a pyramidal structure with plural reflective surfaces, a triangular structure with two reflective surfaces arranged back-to-back, or a cone or truncated cone structure with a curved reflective surface.

4. The bottle according to claim 1, in which the reflective object has a fixed base positioned flat in the bottle.

5. The bottle according to claim 1, in which the incident light is received substantially vertically by the reflective object which directs the reflected light through the second transparent area.

6. The bottle according to claim 1, comprising at least one colored filter arranged along a path of the light, upstream or downstream of the reflecting object.

7. The bottle according to claim 1, in which the decorative pattern forms all or part of a logo, a trademark, or any other distinctive sign.

8. A bottle, comprising:

a body having an interior space;

a watertight housing positioned inside the body; and a reflective object arranged inside the watertight housing, the body including:

a first wall with a first decorative pattern that includes at least one first opaque area and at least one first transparent area, the reflective object being oriented so as to receive an incident external light and to redirect a reflected light onto the transparent areas of the first wall, to provide a back-lighting of the at least one first transparent area.

9. The bottle according to claim 8, comprising:

a second wall with first decorative pattern that includes at least one second opaque area and at least one second transparent, wherein:

the reflective object comprises plural reflective surfaces or a non-planar reflective surface to reflect incident light rays along different reflection axes, in order to back-light each of the first and second transparent areas.

10. The bottle according to claim 8, in which the reflective object comprises reflective surfaces arranged according to a pyramidal arrangement.

11. The bottle according to claim 8, in which the reflective object comprises a reflective surface in the form of a cone or a truncated cone.

12. The bottle according to claim 8, in which the reflective object comprises two reflective surfaces arranged back-to-back according to a triangular arrangement.

13. The bottle according to claim 8, in which the reflective object has a base positioned flat in the bottle.

14. The bottle according to claim 8, in which the first wall is an external wall of the body.

15. The bottle according to claim 8, in which the incident light is received substantially vertically by the device and the reflective object reflects the reflected light through the at least one first transparent area.

16. The bottle according to claim 8, comprising at least one colored filter arranged along a path of the light, upstream or downstream of the reflecting object.

17. The bottle according to claim 8, in which the at least one first transparent area form all or part of a decorative element, of a logo, of a trademark, or any other distinctive sign.

18. The bottle according to claim 8, in which the first wall is a lid of the body and the body also includes a second wall that is transparent, the reflecting object being oriented to receive the incident light through the at least one transparent area and project the reflected light through the second wall as a reflected image of the decorative pattern.

19. The bottle according to claim 8, in which the first decorative pattern is positioned outside of the watertight housing.

* * * * *